United States Patent [19]

Slade

[11] 4,156,528

[45] May 29, 1979

[54] APPARATUS FOR INDICATING COLOR

[76] Inventor: John T. Slade, 170 Cambridge Rd., Seven Kings, Ilford, Essex, England

[21] Appl. No.: 773,797

[22] Filed: Mar. 2, 1977

[30] Foreign Application Priority Data

Mar. 3, 1976 [GB] United Kingdom ..... 8445/76
Dec. 7, 1976 [GB] United Kingdom ..... 50956/76

[51] Int. Cl.[2] ..... A63F 3/00

[52] U.S. Cl. ..... 273/282; 40/2 R; 273/284; 273/290; 273/DIG. 27

[58] Field of Search ..... 273/131 BA, 134 GM, 273/136 E, 137 AD, DIG. 27, 265, 282, 290, 284; 35/35 A; 40/2 R

[56] References Cited

U.S. PATENT DOCUMENTS

| | | | |
|---|---|---|---|
| 486,308 | 11/1892 | Watt | 273/137 AD UX |
| 1,668,328 | 5/1928 | Martien | 273/DIG. 27 |
| 3,215,435 | 11/1965 | Rheingruber | 273/DIG. 27 |
| 3,356,369 | 12/1967 | Stubbmann | 273/136 E |
| 3,568,357 | 3/1971 | Lebensfeld | 273/137 AD |
| 4,022,473 | 5/1977 | Foley | 273/265 |

FOREIGN PATENT DOCUMENTS

| | | | |
|---|---|---|---|
| 384000 | 5/1924 | Fed. Rep. of Germany | 273/282 |
| 841559 | 6/1952 | Fed. Rep. of Germany | 273/290 |

OTHER PUBLICATIONS

Aids & Appliances, Eighteenth Edition, Jul. 1972-Jun. 1973, p. 10.

*Primary Examiner*—Anton O. Oechsle
*Attorney, Agent, or Firm*—Fleit & Jacobson

[57] ABSTRACT

Apparatus for indicating color by the sense of touch, which said apparatus is in the form of a game comprising a playing board with playing holes in it and at least two sets of playing pieces, the playing pieces in each said set each having a different shape, and each different shape representing a different color whereby blind, color blind and partially sighted persons can play said game with sighted persons and because said blind, color blind and partially sighted persons can determine color by feeling the shape of the playing pieces they can refer to the color of the playing pieces and are thus not placed at a psychological disadvantage to said sighted persons who play said game by referring to the color of said playing pieces.

3 Claims, 8 Drawing Figures

APPARATUS FOR INDICATING COLOR

FIELD OF THE INVENTION

The present invention relates to apparatus for indicating colour by the sense of touch, the apparatus being especially beneficial to blind, colour blind and partially sighted persons.

BACKGROUND OF THE INVENTION

Blind, colour blind and partially sighted persons are often made to feel inferior because they cannot converse with normally sighted persons about the colour of objects such for example as playing pieces in games or articles of clothing.

OBJECT OF THE INVENTION

It is the object of the present invention to provide apparatus for indicating colour by the sense of touch whereby a blind, colour blind or partially sighted person can feel the shape of a device, know that that device represents a certain colour, and can then refer to colour in the same manner as a normally sighted person.

Accordingly, this invention provides apparatus for indicating colour by the sense of touch, which apparatus comprises devices which each have a different shape, each shape representing a different colour.

By way of example, it is mentioned that the following shapes may represent the following colours:

| DEVICE | COLOR |
|---|---|
| Square | Black |
| Circle | White |
| Shamrock | Green |
| Star | Blue |
| Petal | Yellow |
| Cross | Red |
| Hexagon | Brown |
| Triangle | Pink |

Obviously, different shape/colour combinations could be employed if desired.

A combination of two or more of the devices may be used to represent the colour that would result from combining the two or more colours represented by the individual devices. For example, a square device (representing black) may be combined with a star device (representing blue) to represent navy blue. Also, a star device (representing blue) may be combined with a circle device (representing white) to represent light blue.

The apparatus of the invention may be used in games, the devices then constituting different playing pieces.

Examples of games that may be played with the apparatus of the invention and where more than two different colours may need to be represented include Ludo, Home-you-go, Five-in-a-row, Mastermind, Monopoly, Snakes and Ladders and Chinese chequers.

The playing pieces for the games preferably have a locating portion for locating each playing piece in a chosen playing hole on a playing board. Advantageously, the locating portion is conically shaped since the tip of the conical shape is relatively easy to fit in the chosen playing hole. If a locating portion with a wide flat parallel sided tip is used, then the locating portion has to be positioned exactly in line with the hole and this may be difficult to do for a blind or partially sighted person.

The locating portion of each playing piece is preferably hollow so that it can receive the locating portion of another playing piece, whereby the playing pieces can be stacked on top of one another, for example in the home position in Ludo. In order to facilitate firm stacking of the playing pieces, the base of the conically shaped portion preferably extends into a first parallel sided portion, this first parallel sided portion being joined to a second larger diameter parallel sided portion by a shoulder. The base of the second parallel sided portion can then extend into a flange which is of larger diameter than the second parallel sided portion and which is shaped to represent a colour.

The playing pieces are preferably used on a specially designed playing board. Obviously, different types of playing boards will be required for some games but generally, the playing boards preferably have holes for receiving locating portions of the playing pieces. Advantageously, each hole is surrounded by a raised lip which can be felt by the players to assist in giving them some idea of the layout of the board and also to assist them in locating the holes. The playing boards may be made of cardboard, thick paper, plastics materials, wood or metal. If desired, the playing board may be made of a flat coloured base, e.g. of cardboard, with a top vacuum-formed playing surface positioned on top of the base.

In one preferred construction of playing board, the playing board is adapted to be sectioned as desired by one or more strips of material, e.g. of the same material as the playing board. The strips of material may have downwardly depending sides which enable the strips to fit over the raised lips of the holes in the board. Alternatively, the strips could have downwardly depending locating members which could go in the holes in the board. The strips may be provided with a longitudinally extending upstanding flange for masking parts of the board if desired, e.g. for hiding a Mastermind code.

The apparatus of the invention may also be used in games where it is only necessary to distinguish between two colours, which two colours will usually be black and white. Examples of these games are Draughts and Backgammon. The playing pieces will usually be constructed as described above.

The apparatus of the invention may also be used for identifying the colour of items in the home and/or in industry. Thus, for example, items that may have their colour indicated are clothes such for example as shirts, ties, socks, shoes, suits, coats, dresses and knitwear. Examples of other items are footwear, sewing cottons, knitting wool, shoe polishes and shoe brushes, electrical wiring looms, drawing or colouring devices, folders and filing systems.

The devices may be fixed to the items to have their colour identified by any suitable means such for example as by adhesives, sewing or tying. With adhesives, the devices may be ironed into position. The devices may be flat and may take the form of shaped discs or shaped rings.

For the mother who is blind but who has a sighted baby, the apparatus of the invention can be used to enable the mother to relate the colour of the child's play-things to the child. Other teaching applications of the invention will be apparent. With items of clothing, the blind or partially sighted person, or even a colour-blind person, can easily match up items of clothing for wearing or for washing so that colours will not run in the wash.

The devices may be made from various materials such as wood and metals. It is presently preferred to use plastics materials since the various shapes can easily be produced by moulding.

BRIEF DESCRIPTION OF THE DRAWINGS

Embodiments of the invention will now be described solely by way of example with reference to the accompanying drawings in which.

DETAILED DESCRIPTION OF THE DRAWINGS

Figure 1:
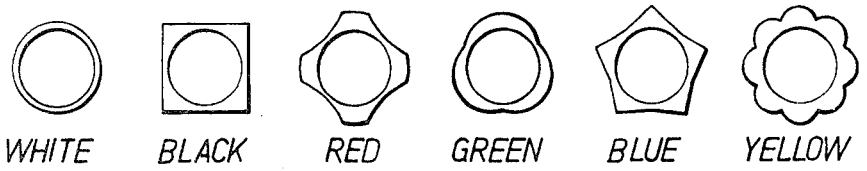
FIG. 1 shows basic devices (or parts of devices) of different shape used to represent different colours.

Referring to FIG. 1, there is shown a circular device representing white, a square device representing black, a cross device representing red, a shamrock device representing green, a star device representing blue and a petal device representing yellow.

Figure 2:
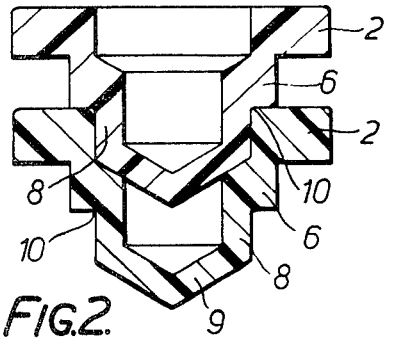
FIG. 2 is a cross-section through two devices stacked on top of each other.

In FIG. 2, two devices representing white are shown, the circular shape being formed on each device as a circular flange 2. The flange 2 has a short skirt portion 6 depending from it. The skirt portion 6 is joined as shown to a short tube section 8 which is of narrower diameter than the skirt portion 6. A shoulder 10 is formed at the junction of the skirt portion 6 and the tube section 8. The tube section 8 extends into a conical section 9. The tip of the conical section 9 enables the playing piece to be inserted into a hole on the playing board more easily than if the conical section 9 were not present and the playing piece had a flat bottom portion.

Figure 3:
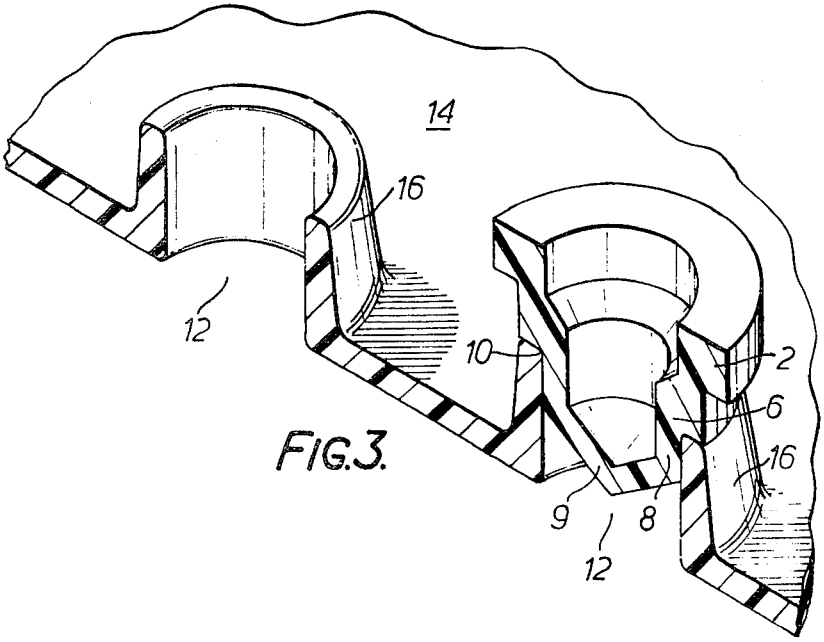
FIG. 3 is a cross-section through one of the devices shown in FIG. 2 and in a hole in part of a playing board.

In FIG. 3, one of the white playing pieces shown in FIG. 2 is shown positioned in a hole 12 of a playing board 14. Each hole 12 is surrounded by an upstanding flange 16 which can easily be felt by a blind or partially sighted person. As is shown in FIG. 3, the white playing piece sits on the flange 16 with the top of the flange engaging the shoulder 10. In this position, only the outer circumference of the tube section 8 is in engagement with the inner surface of the flange 16 so that the playing piece can easily be pulled out of the holes 12, especially since the skirt portion 6 and the flange 2 combine to form a convenient finger grip for enabling purchase to be obtained on the playing piece.

Figure 4:
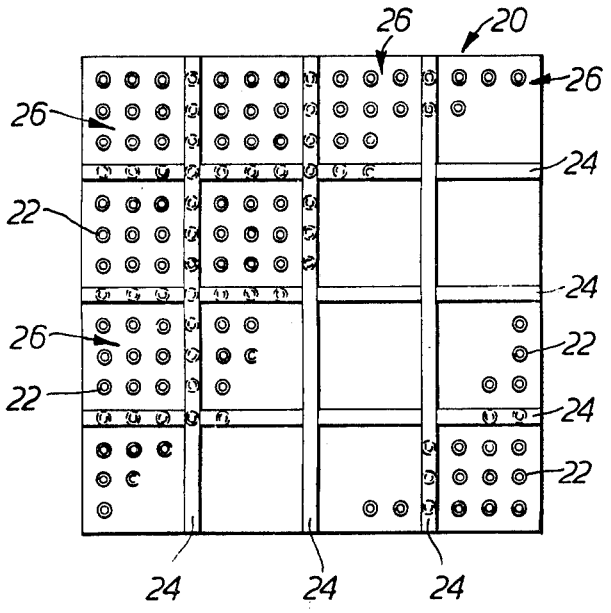
FIG. 4 shows the playing board of FIG. 3 divided into a first sectionalised arrangement.

In FIG. 4, there is shown a square playing board 20 which is provided with holes 22. The holes 22 are preferably surrounded by a locating lip 16 as shown in FIG. 3. The playing board 20 is shown divided by dividing strips 24 into sixteen playing areas 26 each containing nine holes 22 as three rows of three. The game of noughts and crosses can thus be played in each of the sixteen playing areas. As is well known, the game of noughts and crosses will be played between two persons with two sets of differently shaped playing pieces.

Figure 5:
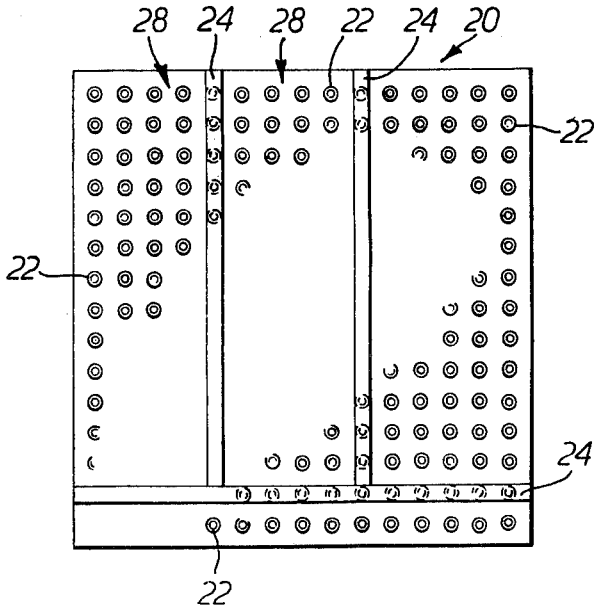
FIG. 5 shows the playing board of FIG. 3 divided into a second sectionalised arrangement.

In FIG. 5, the playing board 20 is shown divided by the playing strips 24 into two playing areas 28 and these playing areas 28 can be used for playing Standard Mastermind. When playing Standard Mastermind the area of the playing board 20 marked with a cross is not required. If the playing strips 24 are moved to the right as shown in FIG. 5, to give two playing areas 28 having five rows of thirteen holes 22, then Super Mastermind can be played.

Figure 6:
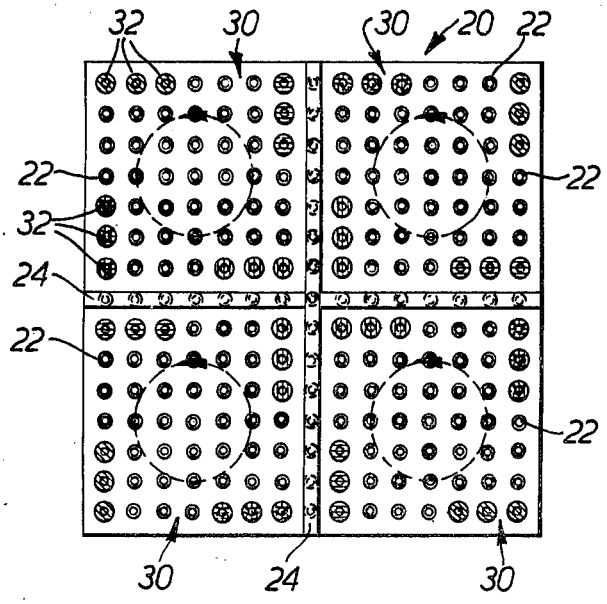
FIG. 6 shows the playing board of FIG. 3 divided into a third sectionalised arrangement.

In FIG. 6, the playing board 20 is shown divided by the playing strips 24 into four playing areas 30. If four sets of three playing pieces are positioned in each playing area 30, then a new game call Chase can be played. In this game, the winner is the first person who can move all his playing pieces 32 around the periphery of his playing area 30 and back to the starting position shown in FIG. 6. The game has some similarities to Chinese Chequers and it is permissible for a player to jump over playing pieces 32 that are separated by unfilled holes 22.

Figure 7:
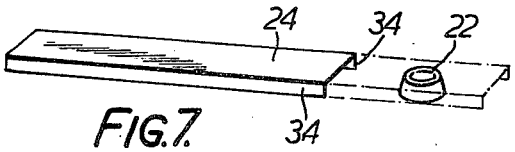
FIG. 7 shows a strip used for sectionalising the board in FIGS. 4–6.
Figure 8:
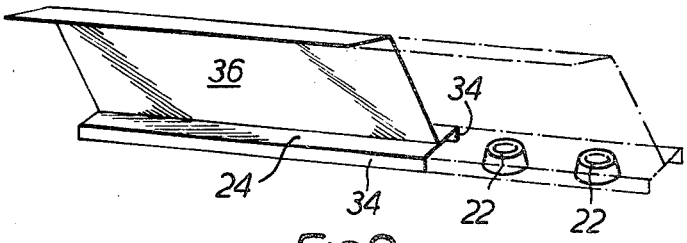
FIG. 8 shows a modified strip.

A dividing strip 24 is shown in perspective view in FIG. 7. The strip 24 is provided with downwardly depending sides 34 which fit over the hole lips 16 shown in FIG. 3. In FIG. 8, the strip 24 is shown modified with a masking shield 36 for masking a part of the playing board 20, e.g. as may be required in Mastermind to hide a code.

It is to be appreciated that the embodiments of the invention described above have been given by way of example only and that modifications may be effected. Thus, for example, other colours could be used for the shapes given or other shapes could be used for other colours, for example a hexagon shape for brown or a triangular shape for pink.

I claim:

1. Apparatus for indicating colour by the sense of touch, which said apparatus is in the form of a game comprising playing pieces and a playing board with holes in it for receiving the playing pieces, said holes in the playing board being surrounded by an upstanding lip for easily locating the holes by touch, each playing piece having a peripheral portion of a predetermined shape which is adapted to be gripped by a player and which indicates to the player a colour by the sense of touch, different shapes indicating different colours and each peripheral portion being rotatable in a player's fingers and being of such a symmetrical shape that it feels the same at different peripheral points whereby a player does not have to feel around the entire peripheral portion in order to determine its shape; and each playing piece having a skirt portion which depends from the peripheral portion and which is adapted to rest on the playing board around a said hole in the playing board to space the peripheral portion away from the playing board so that the peripheral portion can easily be felt for recognition of its shape and so that the playing piece can easily be gripped and moved from hole to hole in the playing board; and each playing piece having a locating portion which is adapted to fit in the holes in the playing board, the locating portion having a cylindrical part for firmly engaging the playing piece in a said hole in the playing board and for cooperating with the skirt portion to prevent the playing piece being accidentally dislodged from a said hole in the playing board and a pointed part extending from the cylindrical part to form a lead-in portion for facilitating locating the playing piece in a said hole in the playing board; and each playing piece being provided with a centrally located aperture that extends inwardly of the playing piece from the peripheral portion and which enables the playing pieces to be stacked on top of one another with the cylindrical part of the locating portion of one playing piece fitting into the aperture of the next lowermost playing piece and the skirt portion of the said one playing piece resting on the peripheral portion of the said next lowermost playing piece to give firmly stacked playing pieces that do not get accidentally dislodged; and the apparatus being such that blind, colour blind and partially sighted players can play the game with sighted players and because the blind, colour blind and partially sighted players can determine colour by feeling the shape of the playing pieces they can refer to the colour of the playing piece and are thus not placed at a psychological disadvantage to the sighted players who play the game by referring to the colour of the playing pieces.

2. Apparatus according to claim 1 in which the following shapes represent the following colours:

| SHAPE | COLOUR |
|---|---|
| Square | Black |
| Circle | White |
| Shamrock | Green |
| Star | Blue |
| Petal | Yellow |
| Cross | Red |
| Hexagon | Brown |
| Triangle | Pink |

3. Apparatus according to claim 1 in which a combination of two or more of the shapes represents the colour that would result from combining the two or more colours represented by the individual shapes.

* * * * *